US006145897A

United States Patent [19]

Locher

[11] Patent Number: 6,145,897

[45] Date of Patent: Nov. 14, 2000

[54] PUSH-BAR FOR DOORS IN GENERAL

[76] Inventor: Gebhard Heinrad Locher, 39058, Sarentino, Italy

[21] Appl. No.: 09/250,256

[22] Filed: Feb. 16, 1999

[30] Foreign Application Priority Data

Mar. 11, 1998 [IT] Italy ..... MI98A0492

[51] Int. Cl.[7] ..... E05B 65/10

[52] U.S. Cl. ..... 292/92; 292/168; 292/DIG. 65; 70/92

[58] Field of Search ..... 292/92, 93, 94, 292/DIG. 65, 168, 174, 227; 70/92

[56] References Cited

U.S. PATENT DOCUMENTS

| | | | |
|---|---|---|---|
| 2,320,298 | 5/1943 | Phillips . | |
| 3,024,053 | 3/1962 | Cox et al. . | |
| 3,464,728 | 9/1969 | Ruckel et al. . | |
| 3,636,740 | 1/1972 | Rollins | 70/92 |
| 3,730,574 | 5/1973 | Zawadzki | 292/92 |
| 3,970,339 | 7/1976 | Haselton et al. | 292/227 |
| 4,006,471 | 2/1977 | Pappas | 340/274 R |
| 4,083,590 | 4/1978 | Folger | 292/92 |
| 4,145,900 | 3/1979 | Ohno | 70/92 |
| 4,167,280 | 9/1979 | Godec et al. | 292/92 |
| 4,181,335 | 1/1980 | Thoren | 292/92 |
| 4,895,399 | 1/1990 | Horgan, Jr. | 292/92 |
| 4,906,034 | 3/1990 | Verslycken | 292/92 |
| 5,088,786 | 2/1992 | Linder | 292/92 |
| 5,490,696 | 2/1996 | Hutson | 292/92 |

*Primary Examiner*—B. Dayoan
*Assistant Examiner*—Clifford B Vaterlaus
*Attorney, Agent, or Firm*—Guido Modiano; Albert Josif; Daniel O'Byrne

[57] ABSTRACT

A push-bar for doors in general, which comprises a bar element provided, at its ends, with couplings for connection to a door; the particularity of said push-bar is the fact that it is provided with a threaded bar which is arranged inside the bar element, each end of said bar element being connected to lever means which are in turn pivoted at one end to the bar element and, at the other end, to a pusher whose rotation as a consequence of a pressure applied to the bar element causes the rotation of a pawl which is adapted to engage the pivot of the lock of the door in order to turn it for opening, an empty space being provided between the bar element and the surface of the door to which the bar element is connected.

9 Claims, 4 Drawing Sheets

PUSH-BAR FOR DOORS IN GENERAL

BACKGROUND OF THE INVENTION

The present invention relates to a push-bar for doors in general. More particularly, the invention relates to a push-bar for emergency doors and the like.

It is known that push-bars are provided for doors in general and more particularly for emergency doors and the like, allowing to quickly open the emergency door without having to turn any handle.

Said push-bars in fact have a transverse bar which, when pushed by the body of a person, allows the emergency door to open without said person having to use his hands to open it.

As mentioned, conventional push-bars for emergency doors and the like are constituted by a transverse bar which can be connected to the door in different manners. In particular, a type of push-bar is known which cantilevers out from the door to which it is fixed but has the drawback of being considerably thick and of not being aesthetically pleasant.

Another type of push-bar is constituted by a bar which is arranged transversely to the door and is connected thereto by insertion in a C-shaped profiled element having the same length as the bar.

In this manner, the bar is operated by pushing since it is accommodated within the C-shaped profiled element along its entire length.

The drawback of this conventional push-bar is that there is no space between the C-shaped profiled element and the bar accommodated therein and therefore the user cannot grip said bar with his hands and accordingly cannot open in a normal way the door to which the push-bar is connected.

Moreover, the length of the bar element of the push-bar is determined by the length of the corresponding C-shaped profiled element and must therefore be preset.

SUMMARY OF THE INVENTION

The aim of the present invention is therefore to provide a push-bar for doors in general in which there is a space between the push-bar and the surface of the door to which said push-bar is connected, so as to be able to grip said push-bar.

Within the scope of this aim, an object of the present invention is to provide a push-bar for doors in general in which the push-bar is operated by pushing and with a movement at right angles to the surface of the door to which said push-bar is connected.

Another object of the present invention is to provide a push-bar for doors in general in which the length of the bar element can be easily determined at the time of installation according to the distance between the couplings of the push-bar.

Another object of the present invention is to provide a push-bar for doors in general which also has an aesthetically pleasant appearance.

Another object of the present invention is to provide a push-bar for doors in general which is highly reliable, relatively easy to manufacture and at competitive costs.

This aim, these objects and others which will become apparent hereinafter are achieved by a push-bar for doors in general, comprising a bar element provided, at its ends, with couplings for connection to a door, characterized in that it comprises a threaded bar arranged inside said bar element, each end of said bar element being connected to lever means which are in turn pivoted to said bar element at one end and are pivoted, at the other end, to a pusher whose rotation as a consequence of a pressure applied to said bar element causes the rotation of a pawl which is adapted to engage the pivot of the lock of said door in order to turn it for opening, an empty space being provided between said bar element and the surface of said door to which said bar element is connected.

BRIEF DESCRIPTION OF THE DRAWINGS

Further characteristics and advantages of the invention will become apparent from the following description of a preferred but not exclusive embodiment of the push-bar according to the invention, illustrated by way of a non-limitative example in the accompanying drawings, wherein.

DESCRIPTION OF THE PREFERRED EMBODIMENTS

Figure 1:
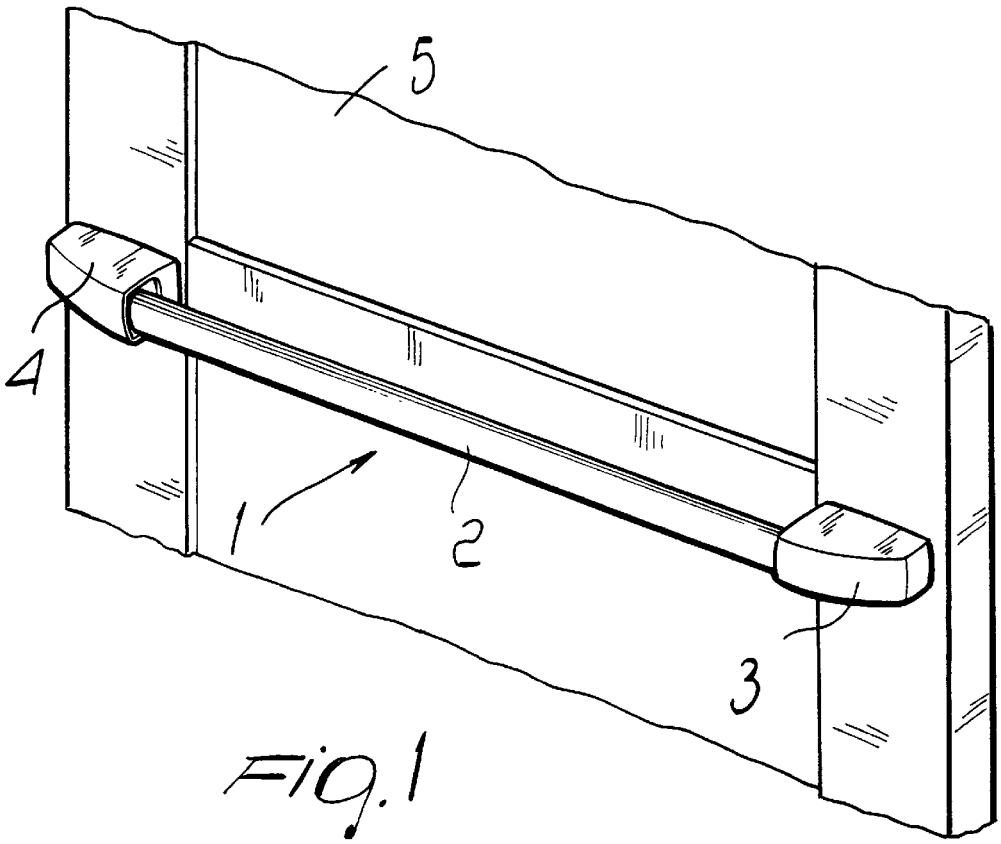
FIG. 1 is a perspective view of the push-bar according to the invention, applied to a door.

With reference to the above Figures, the push-bar according to the present invention, generally designated by the reference numeral 1, is formed by a bar element 2 which is supported by end couplings, shown in greater detail hereinafter, with enclosures 3 and 4 which give the push-bar 1 a pleasant appearance.

In FIG. 1, the push-bar 1 is shown connected to a door 5 which is only partially shown.

The end couplings which allow the connection of the bar element 2 to the surface of the door 5 are now described with reference to FIGS. 2–8.

The bar element 2 is provided with a through hole 6 in which there slides a bar 7 which is threaded at its ends.

The bar 7 is straight and engages, at one end, a threaded hole provided in a first block 8, while its other end is slideable within a hole provided in a second block 9 arranged at the opposite end of the first block 8.

The bar element 2 ends, at both ends, with a pair of shoulders 10 and 11, each one provided with a hole 12. A tab 44, protruding vertically with respect to the bar element 2, acts as a cover for the mechanism for coupling the bar element 2 to the door 5.

Lever means are respectively connected to the shoulders 10 and 11 and are conveniently constituted by plates 13 and 14 provided with a first pair of holes 15 and 16, a second pair of holes 17 and 18 and a third pair of holes 19 and 20.

A pusher, designated by the reference numeral 25, is provided as a part of the coupling of the bar element 2 to the door 5.

Said element 25 in turn has two holes 26 and two holes 27 arranged on end portions of the element 25.

The holes (corresponding to the holes 27) of the element 25 arranged at the end of the bar element 2 that lies opposite the end at which the door lock is located are oval, so as to form a pair of slots designated by the reference numerals 60.

Finally, a plate-like element with raised edges and with a C-shaped profile, designated by the reference numeral 30, is provided for connecting the bar element 2 to the assembly for coupling to the door 5. In particular, the element 30 is fixed to the door 5 by means of the holes 31 and the raised walls of the element 30, which are in turn provided with holes 32, 33 and 34, allow to connect the other elements of the coupling of the bar element 2.

The plate-like element with raised walls and a C-shaped profile, designated by the reference numeral 30, is provided, for one of the two ends of the bar element 2 which is meant to engage the lock of the door 5, with a pawl 40 which has a substantially square central hole 41, adapted to engage the pivot of the lock of the door 5.

In particular, the element 30 that is meant to make contact with the pivot of the door 5 and is accordingly provided with the pawl 40 is provided with a perforated plate 42 acting as a stop element for the pawl 40, which engages in the hole of the plate 42.

The other element 30, arranged at the opposite end, is therefore provided neither with the pawl 40 nor with the plate 42.

The operation of the pawl 40 for opening the door 5 is described in detail hereinafter.

Figure 2:
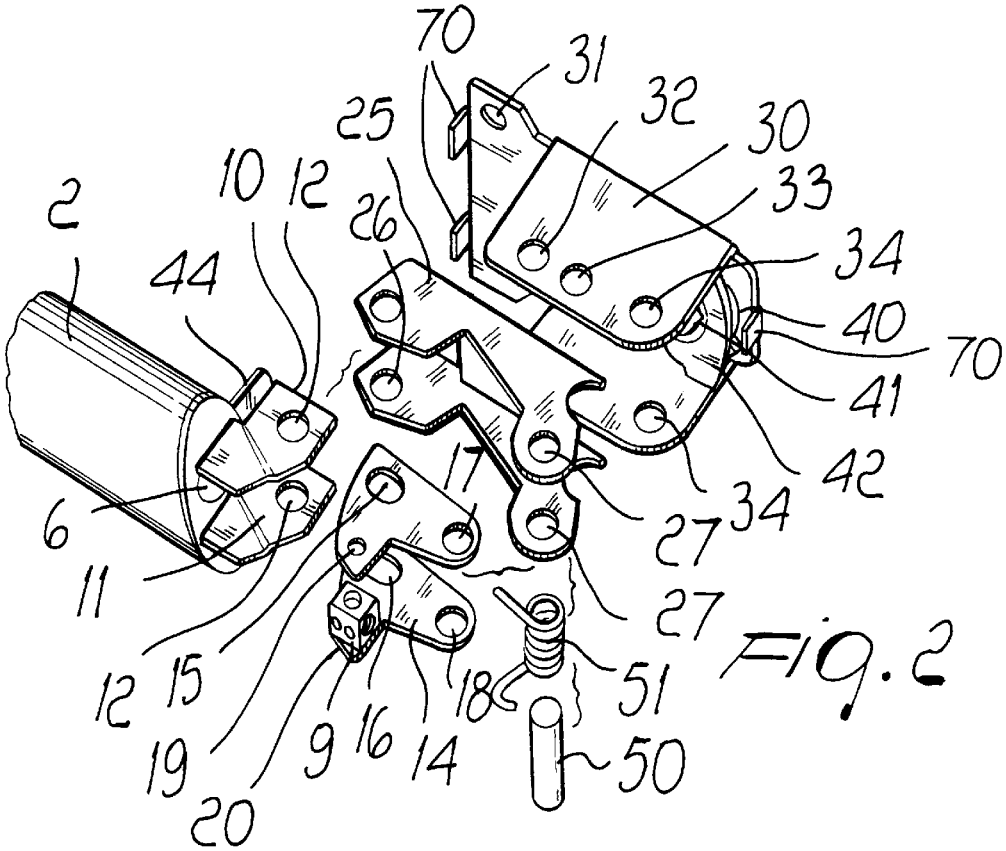
FIG. 2 is an exploded perspective view of one of the ends of the push-bar according to the present invention.
Figure 3:
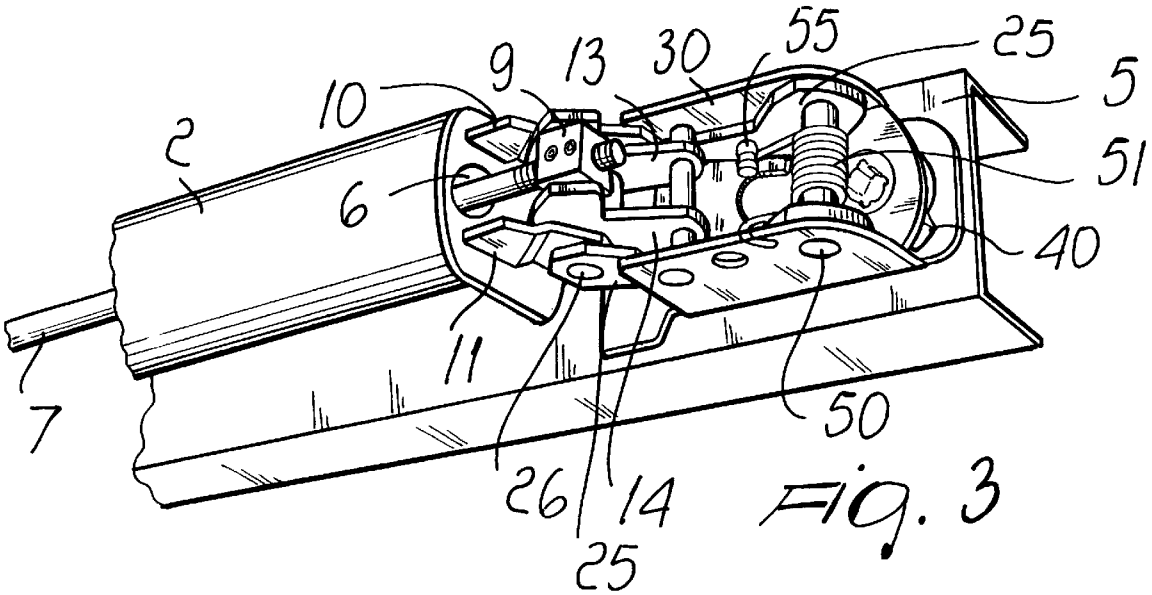
FIG. 3 is a perspective view of the other end of the push-bar according to the present invention.
Figure 4:
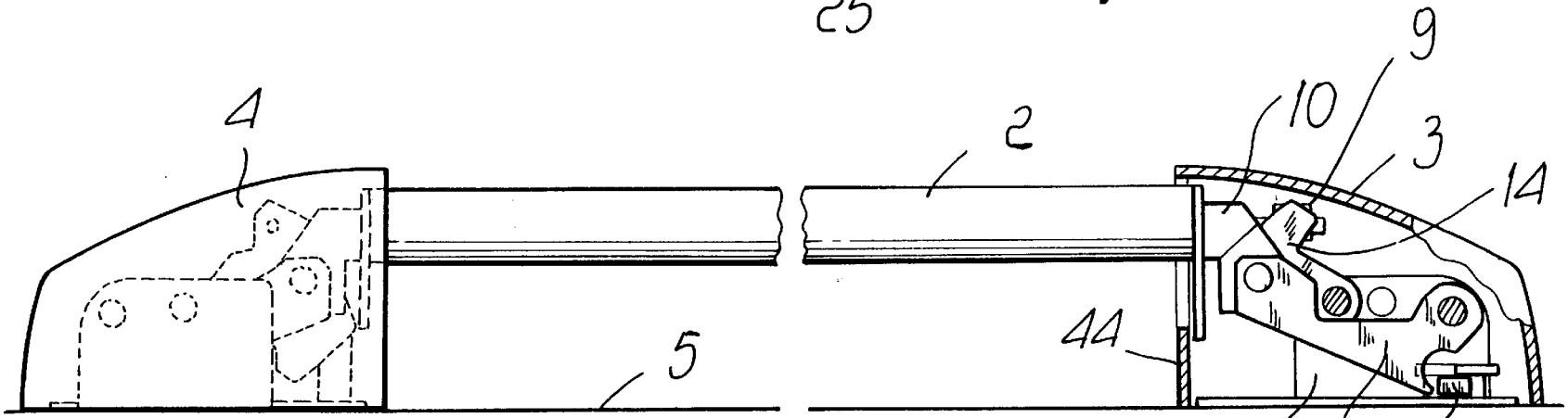
FIG. 4 is a partially sectional plan view of the push-bar according to the present invention.
Figure 5:
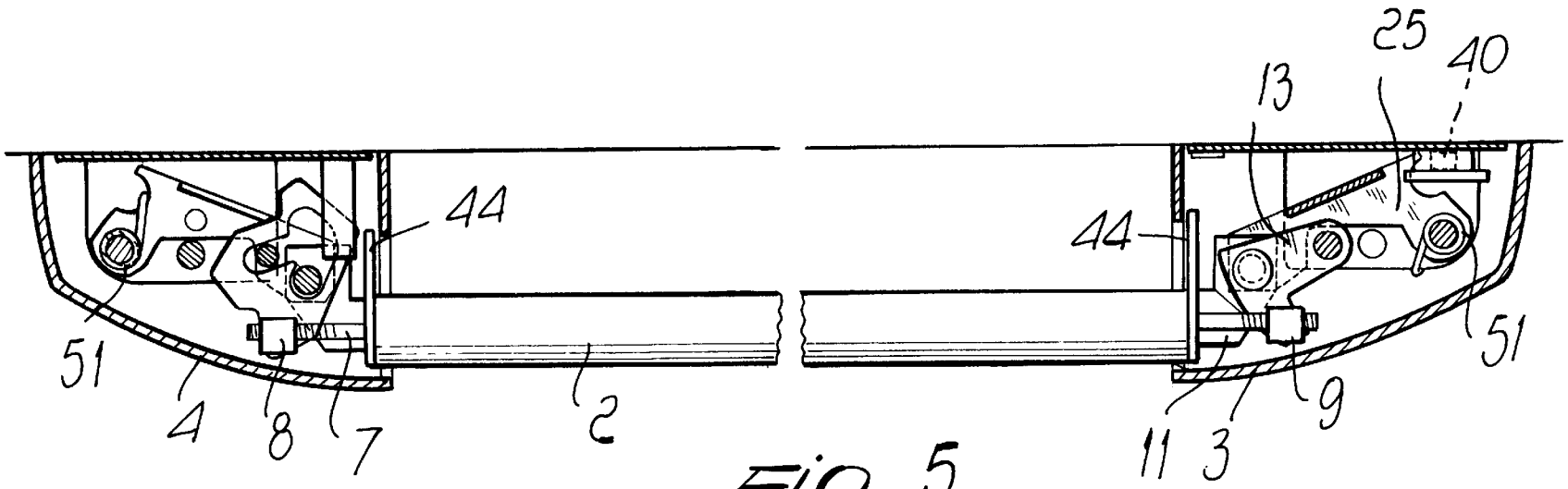
FIG. 5 is a sectional plan view of the push-bar according to the present invention.
Figure 6:
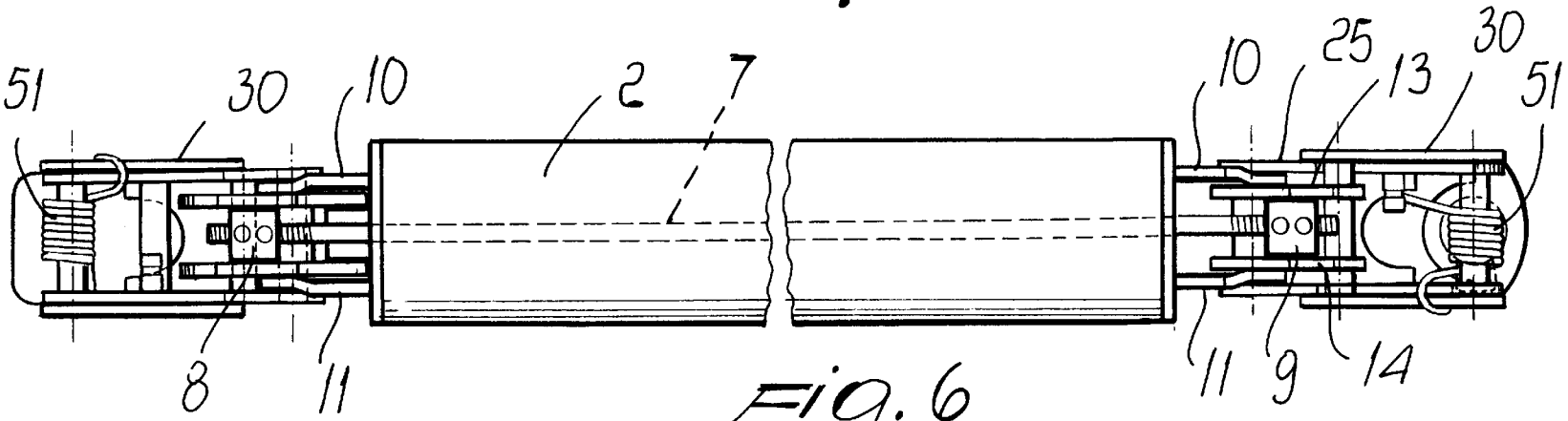
FIG. 6 is a front view of the push-bar according to the present invention.

The connection of the various elements that are part of the assembly for coupling the bar element 2 to the door 5 is now described with particular reference to FIG. 2, which is an exploded view of said elements.

The second block or fixing element 9 is accommodated between the plates 13 and 14 and is locked by means of a pivot which passes through the holes 19 and 20 of the plates 13 and 14.

The threaded bar 7 then enters the hole of the fixing element 9 and is locked therein according to the user's requirements, as described in greater detail hereinafter.

The plates 13 and 14 are in turn accommodated within the shoulders 10 and 11, while the pusher 25 is arranged so as to surround the shoulders 10 and 11, which accordingly rest within its vertical walls.

The holes 26 of the pusher 25 therefore coincide with the holes 15–16 and 12–13 so that, by means of a pivot which passes through said holes, the pusher 25 and the plates 13 and 14 are rigidly coupled to the shoulders 10 and 11, in turn rigidly coupled to the bar element 2.

In the non-actuated condition, the plates 13 and 14 assembled to the bar element 2 lie above the bottom surface of the pusher 25. The plates 13 and 14 are in turn connected, by way of the holes 17 and 18, to the holes 32 of the C-shaped plate-like element 30.

It should be observed that the holes 15 and 16 of the plates 13 and 14 are substantially elliptical.

The holes 27 of the pusher 25 instead coincide with the holes 34 of the C-shaped plate-like element and are locked thereat by a pivot 50 around which a coiled spring 51 is coupled which accordingly engages a locator 55 formed on the internal wall of the pusher 25.

The spring 51 acts as a return element for returning the bar element 2 to the inactive position at the end of the pushing action, as described in detail hereinafter.

As previously mentioned, the first block or fixing element 8 has a threaded hole which the threaded bar 7 enters and accordingly constitutes a fixed point for said bar 7. Vice versa, the second block or fixing element 9 has a hole whose diameter is larger than the diameter of the threaded bar 7 and accordingly allows to adjust, inside it, the position of the threaded bar 7, tightening it according to the user's requirements.

Figure 7:
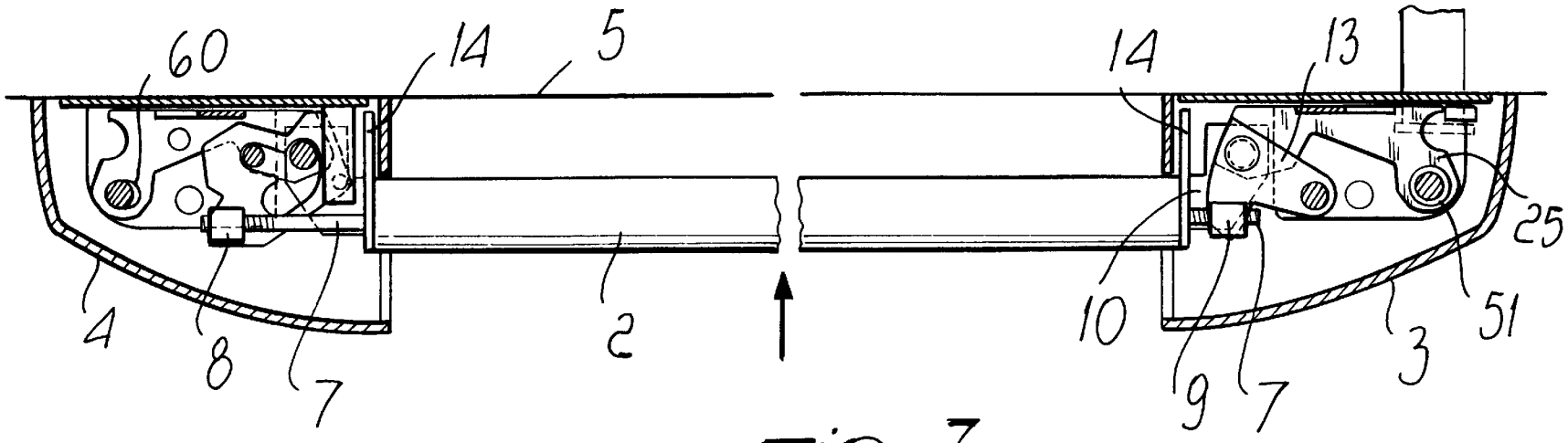
FIG. 7 is a sectional plan view of the push-bar according to the present invention, shown in the operated position.
Figure 8:
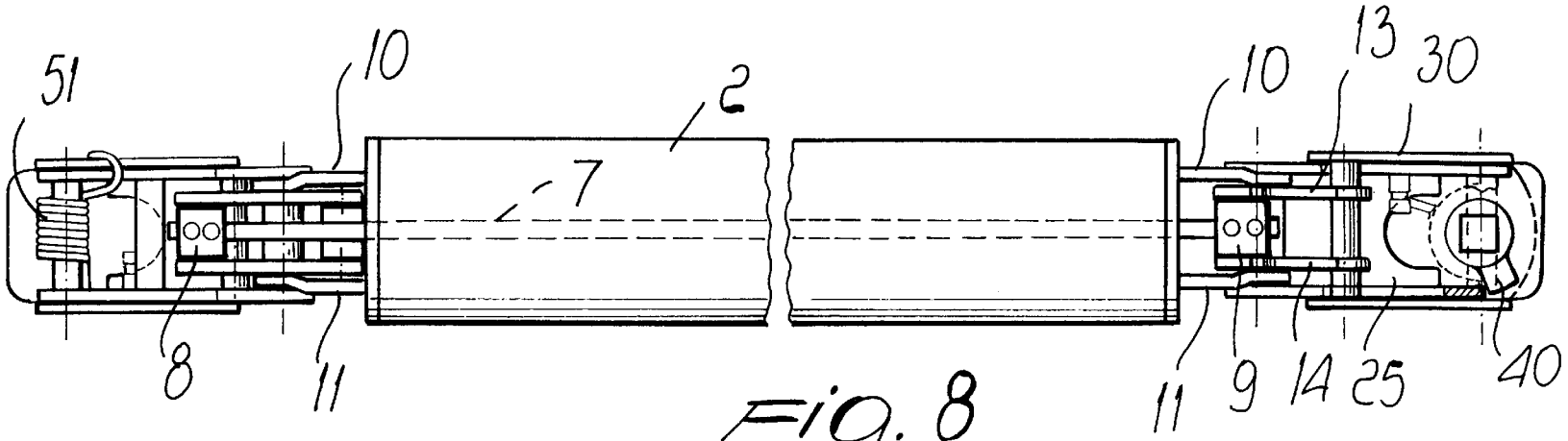
FIG. 8 is a front view of the push-bar according to the present invention, illustrating the mechanism for engaging the pivot of the lock of the door to which the push-bar is connected.

In FIG. 7, the spring 51 has been removed so as to illustrate the slots 60 in detail.

With reference to the above Figures, the operation of the push-bar according to the present invention is as follows.

First of all it should be observed that the push-bar according to the present invention allows to easily select the dimensions of the bar element 2 by cutting it according to the intended size and then inserting therein the threaded bar 7 to lock it in the fixing element 8 and then in the fixing element 9.

When the user pushes on the bar element 2 so as to operate it, he triggers the operation of the coupling mechanism that connects the bar element 2 to the surface of the door 5.

In detail, by pushing the bar element 2, as shown in FIG. 7, said bar element 2 moves vertically with respect to the surface of the door 5: more specifically, the vertical translatory motion of the bar element 2 and therefore of the shoulders 10 and 11 rigidly coupled thereto is carried out, as well as a rotation of the plates 13 and 14 which entails a translatory motion of the threaded bar 7 within the hole of the bar element 2 away from one end of said bar element 2.

Pushing the bar element 2 entails the movement of the coupling of one end of the bar element which leads to a converse movement of the coupling of the other end of the bar element.

The pressure of the bar element further induces the translatory motion of the pusher 25 accommodated within the plate-like element 30 with walls and a C-shaped profile; said pusher whereby moves in pushing engagement with the pawl 40, which is thus induced to rotate in one direction or the other, according to its arrangement and, of course, according to the side of the door 5 on which the push-bar 1 is arranged.

The rotation of the pawl 40 induces the rotation of the pivot of the lock (not shown in the Figures), which thus allows the door 5 to open.

The return of the pawl 40 is produced by the opposite rotation of the pivot of the lock when it snaps closed again following the release of the pressure applied to the bar element 2.

The plate-like element with vertical walls 30 is further provided with three elastic tabs 70, vertically arranged with respect to the base plate of said element and meant to allow the push-fit insertion of the enclosure 3 and 4 so as to avoid the need for fixing screws or similar means.

The couplings arranged at each end of the bar element 2 are therefore exactly identical to each other except, as mentioned above, for the presence of the pawl 40 and of the oval holes 60 at one end.

In practice it has been observed that the push-bar according to the invention fully achieves the intended aim, since a space is provided between the surface of the door and the bar element so that a user can easily grip the bar element without being forced, as occurs in conventional embodiments, to operate the push-bar by exclusively leaning with the hand or other body part against the bar.

The spacing of the bar element from the surface of the door allows to use the push-bar also to pull the door, for example to close it; this is not allowed by push-bars according to the prior art, in which the bar element is accommodated in the profiled element for connection to the door.

Moreover, the possibility to adjust the length of the bar element is considerably simplified, since said bar element can be cut to the chosen size, according to the requirements, and then be easily inserted, with its threaded bar, between the couplings which are meant to connect it to the surface of the door.

The configuration of the couplings provided according to the present invention allows to use a same push-bar for both sides of a door: the only change is in fact constituted by the orientation of the pawl 40 which engages the pivot of the lock.

This of course entails a saving on production costs, since it requires a single model of push-bar.

The push-bar thus conceived is susceptible of numerous modifications and variations, all of which are within the scope of the inventive concept; furthermore all the details may be replaced with other technically equivalent elements.

In practice, the materials used, so long as they are compatible with the specific use, as well as the dimensions, may be any according to the requirements and the state of the art.

The disclosures in Italian Patent Application No. MI98A000492 from which this application claims priority are incorporated herein by reference.

What is claimed is:

1. A push-bar unit for doors in general, comprising: a bar element extending between first and second ends thereof along a plane which is adapted to be perpendicular to a surface plane of the door; couplings provided at the ends of said bar element for connection to the door; a threaded bar, comprising first and second ends thereof and being arranged inside said bar element; a lever having a first and a second pivoting ends; a pusher; a pawl for turning open by engagement a lock pivot of said door; and a free space being delimited by way of said couplings between said bar element and a surface plane of said couplings which is adapted to be connected to said door to which said bar element is connected, said lever being pivoted with the first pivoting end thereof to the bar element and with the second pivoting end to the pusher, said pawl being operatively connected with said pusher, whereby upon rotation of the pusher by action of said lever actuated following pressure applied to said bar element, the pawl rotates for turning open the door lock pivot, wherein said lever is constituted by two mutually parallel plates; a shoulder being rigidly coupled to each of said ends of said bar element, said parallel plates being pivoted to said shoulder; fixing elements being connected to each of said plates, at least a first one of said fixing elements allowing insertion and locking of a first one of the ends of said threaded bar.

2. The push-bar unit of claim 1, wherein a second one of said fixing elements has a passage hole for insertion of a second one of the ends of said threaded bar, said hole having a diameter being greater than the diameter of said threaded bar.

3. The push-bar unit of claim 2, comprising a plate-like element with raised walls which includes a plane surface for connection to the door surface, said pusher being pivoted to said plate-like element.

4. The push-bar unit of claim 3, comprising: a return spring which is connected to said plate-like element and to said pusher, for returning said bar element into an inactive position following a pushing action.

5. The push-bar unit of claim 2, wherein said first end of said threaded bar is screwed in said first one of said fixing elements.

6. The push-bar unit of claim 4, wherein said plate-like element with raised walls has a C-shaped profile.

7. The push-bar unit of claim 3, comprising an enclosure for each one of said couplings of the bar element.

8. The push-bar unit of claim 7, comprising, for each end of said bar element, a covering element, said covering elements being arranged vertically with respect to the surface plane of said door and to the plane along which said bar element extends for covering, together with said enclosure, each of the couplings related to the respective said ends of said bar element.

9. The push-bar unit of claim 8, wherein said plate-like element with raised walls is provided with three elastic tabs, which protrude vertically from the plane surface of said plate-like element for connection to said door, said tabs allowing push-fitting connection of said enclosure, over said couplings.

* * * * *